US007878440B2

(12) United States Patent
Hernandez

(10) Patent No.: US 7,878,440 B2
(45) Date of Patent: Feb. 1, 2011

(54) WINDER WITH PITCH MODULATION AT TRANSVERSE LIMITS

(75) Inventor: Andres Hernandez, West New York, NJ (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 106 days.

(21) Appl. No.: 12/265,356

(22) Filed: Nov. 5, 2008

(65) Prior Publication Data

US 2010/0108797 A1 May 6, 2010

(51) Int. Cl.
*B65H 75/38* (2006.01)

(52) U.S. Cl. ..... 242/397.3; 242/484.1

(58) Field of Classification Search ..... 242/397.2, 242/397.3, 476.7, 477.2, 477.4, 478, 478.2, 242/471, 484, 484.1
See application file for complete search history.

(56) References Cited

U.S. PATENT DOCUMENTS

| | | | | |
|---|---|---|---|---|
| 4,477,035 | A * | 10/1984 | O'Connor | 242/471 |
| 4,568,033 | A * | 2/1986 | O'Connor | 242/471 |
| 4,603,817 | A * | 8/1986 | O'Connor | 242/159 |
| 4,838,500 | A * | 6/1989 | Graham | 242/478.2 |
| 5,078,333 | A * | 1/1992 | Hester | 242/478.2 |
| 6,073,878 | A * | 6/2000 | Egglhuber | 242/478.2 |
| 6,341,744 | B1 * | 1/2002 | Sugiuchi | 242/483.3 |
| 6,789,758 | B2 * | 9/2004 | Duncan | 242/160.2 |

* cited by examiner

*Primary Examiner*—Sang Kim
(74) *Attorney, Agent, or Firm*—Boyle Fredrickson LLP; William R. Walbrun; John M. Miller

(57) ABSTRACT

A winding machine having a user-defined pitch between rotation of a form and translation of a point of winding material along the form, reduces damaging accelerative forces on the machine components by a slight modulation of the pitch near travel-reversal of the point of winding. The pitch of the windings over most of the form is unaffected and rotational speed of the form need not be modified.

12 Claims, 3 Drawing Sheets

WINDER WITH PITCH MODULATION AT TRANSVERSE LIMITS

CROSS-REFERENCE TO RELATED APPLICATIONS

--

BACKGROUND OF THE INVENTION

The present invention relates generally to traverse winding machines for automatic winding of a filament or strip about a rotating form, and in particular to a traverse winding machine providing improved high-speed operation.

Traverse Winding machines are used in a variety of industrial applications, including the winding of filamentous or ribbon-like materials on a spool for storage, the winding of reinforcement materials around forms and vessels, and the manufacture of electrical devices using coils of conductive material.

Generally, winding machines have an arbor rotating about an axis so that material may be wound about the arbor or around a form attached to the arbor. The material to be wrapped around the form is guided to move back and forth along the axis of the arbor to distribute the material evenly over the length of the form during the winding process.

Extremely precise winding distribution can be obtained using modern electronic motor drives. A first motor drive may be used to turn the arbor and a second motor drive may be used to control the position of the material transversely along the axis. The first and second motor drive may be electronically "locked" so that there is a fixed relationship between rotational speed of the arbor and translating speed of the material. In this way, a precise pitch of the wound material may be ensured despite variations in the arbor speed that normally occur to accommodate the changing effective diameter of the form as material is wound upon it.

Using such motor drive systems, the operator may enter particular machine parameters into an industrial controller operating in conjunction with the motor drives. The operator may, for example, enter the linear rate of wound material or its desired tension, the limits of transverse motion of the material on the form, the pitch of material to be applied to the form, and the maximum amount of material to be applied to the form, etc. The industrial controller may then automatically operate the motor drives to move the arbor and the position of the material on the form in a coordinated manner to produce the desired pitch and total winding amount. As the material reaches the limits of transverse motion, the defined pitch is reversed without slowing down the arbor so as to preserve tension relationships on the material being wound on the form and to provide the maximum winding rate.

When the material to be wound is obtained from another process, for example a slitting machine or the like, the position of the wound material with respect to the axis of the arbor may be changed by moving the arbor itself in a reciprocating fashion along its axis. In this way the wound material may follow a straight path from a previous machine or process to the arbor.

SUMMARY OF THE INVENTION

The present inventor has determined that the extremely high forces at the limits of transverse motion of the wound material, particularly when the arbor itself is moved in translation, can be significantly reduced, without changing the arbor speed, by proactively managing the pitch transition rate (rate of change) as the form approaches the reversing limit points. Because the management of pitch transition rate can be constrained to a small distance near the end of the form, the necessary pitch changes may be accommodated even in applications where precise pitch requirements are demanded. The amount of pitch transition rate modification may be accurately computed by from pitch and other machine parameters entered by the user and thus may be automatically determined simplifying setup of the machine. By reducing these high forces of acceleration incident to a change of direction of wound material along the form, wear of the winding machine may be reduced and/or winding speed may be substantially increased without damaging vibration or torque spikes.

Specifically then, the present invention provides a computer-controlled winding machine with an arbor rotatable about an axis to support a form for winding a material over the form. A transverse carriage moves a point of winding of the material on the form over a range of transverse locations along the axis of the arbor. An arbor drive system rotates the arbor and provides an arbor rotation position signal and the transverse carriage drive system moves the transverse carriage according to a transverse carriage signal and provides at least one position signal indicating transverse locations at either axial end of the form. A control system communicates with the arbor drive system and the transverse carriage drive system and executes a stored program to: (a) at positions of the point of winding between the axial ends of the form, lock movement of the transverse carriage to the arbor rotation position signal according to a pitch variable entered by the user and defining a winding pitch of the material; (b) at positions of the point of winding at the axial ends of the form, inverts the sign of the pitch variable at the first and second positions of the transverse carriage drive to reverse direction of the carriage; and (c) at predetermined distances to the axial ends of the form, modulate the pitch transition rate to reduce accelerative forces.

It is thus one object of the invention to provide a method of decreasing the wear and/or increasing the operating speed of a winding machine through an optimized pitch transition rate modulation which takes into account the user-entered pitch value and other machine parameters. By modifying the pitch variable, complex synchronized motion curves for the arbor and carriage need not be determined, the arbor need not be slowed, and the usual trade off between machine speed and winding performance may be avoided The modulation technique manages the pitch transition rate by decreasing the magnitude of the pitch as the carriage is moving toward the closest end of the form and then gradually increasing the magnitude of the pitch as the carriage is moving away from the closest end of the form, the increases and decreases adding to zero.

Thus it is an object of the invention to provide a system that controls damaging accelerative forces through accurately anticipated pitch transition rate variations at the ends of the form where pitch transition rate variations may be readily accommodated while maintaining predictable position lock; resulting in predictable pitch and winding pattern, and otherwise leaving pitch and winding positions unchanged.

The modulation in pitch may be a linear function of arbor position.

It is thus an object of the invention to provide a computationally simple pitch modulation that can ensure a predetermined limit and accelerated forces.

The controller may vary arbor rotational speed during winding.

Thus it is an object of the invention to provide a system that works with variable rotation rate arbors used to accommodate winding form diameter changes as material is added to the form.

The controller may hold arbor rotational speed substantially constant during motion of the carriage through positions within the predetermined distances from the ends of the forms.

It is thus an object of the invention to provide a reduction in force on the carriage without the need to rapidly change the rotational speed of a possibly massive winding form.

The controller may automatically compute the predetermined distances based on a maximum speed of the arbor during winding and a maximum desired acceleration of the carriage.

Thus it is an object of the invention to minimize the modulated distance by accurately computing the pitch transition rate required for a given maximum acceleration limit.

The pitch modulation may be locked to the arbor rotation by a modulation variable.

It is thus an object of the invention to provide for a simple control strategy for pitch modulation.

These particular features and advantages may apply to only some embodiments falling within the claims and thus do not define the scope of the invention.

DETAILED DESCRIPTION OF THE PREFERRED EMBODIMENT

Figure 1:
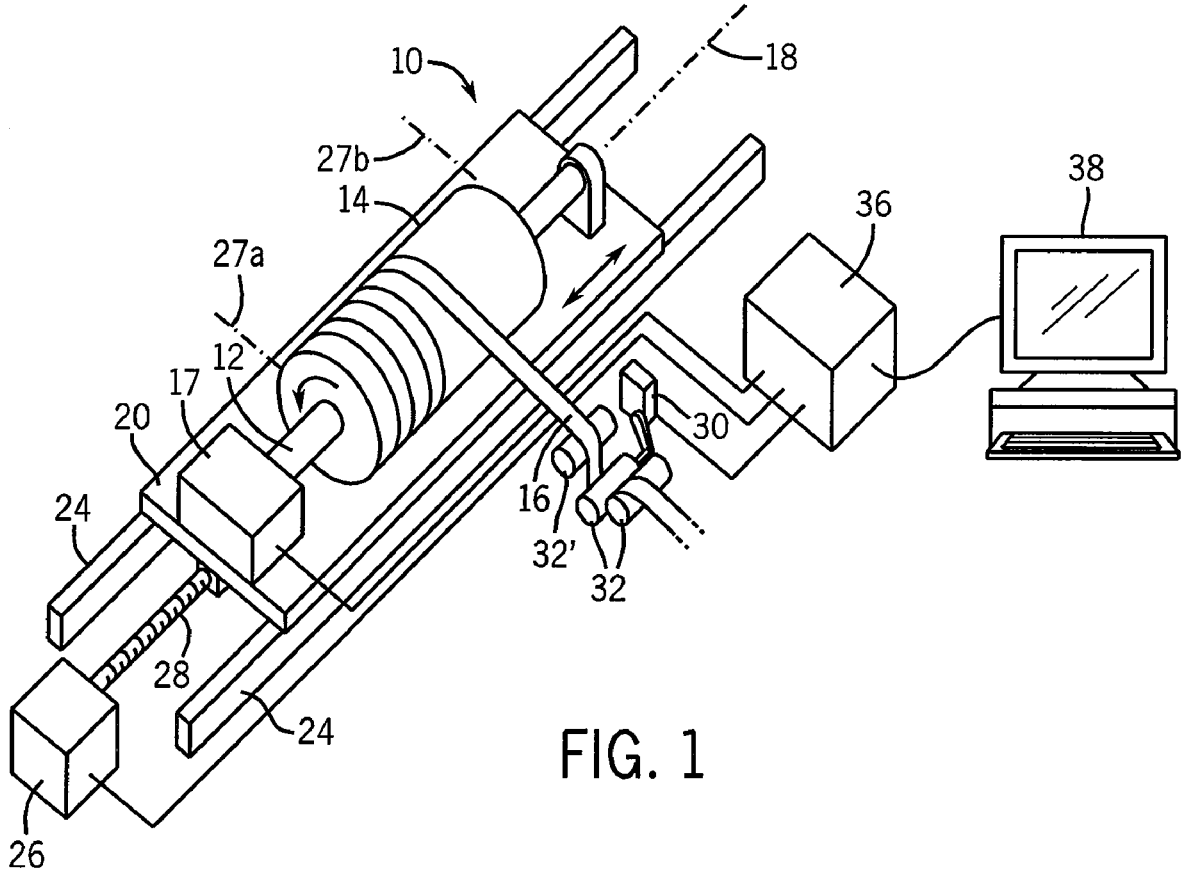
FIG. 1 is a simplified perspective view of a winding machine showing an arbor for rotation about an axis as driven by a first motor drive and a carriage moving transversely as driven by a second motor drive to control the winding point of a material on the arbor, the first and second motor drives under the control of a programmable controller.

Referring now to FIG. 1, a winding machine 10 may include an arbor 12 holding, for example, a spool or a form 14 about which material 16 will be wound. The arbor 12 may rotate about axis 18 as driven by a first motor drive system 17.

Motor drive systems are well known in the art and as described herein provide an appropriately sized motor, either permanent magnet synchronous or induction-type, together with drive electronics providing power to the motor to control speed, torque, position and the like. Motor drive systems and their components, suitable for the present invention, are available from Rockwell Automation Inc. of Milwaukee, Wis., for example, as commercially available under the tradename of Kinetix 6000.

In the present embodiment, motor drive system 17 includes a rotation sensor such as a rotary encoder from which the angular position and angular velocity of the arbor 12 may be determined. Generally, the motor drive system 17 operates to control the rotational velocity of the arbor 12 and to provide a readout of the angular position of the arbor 12.

The arbor 12 and motor drive system 17 may be positioned on a carriage 20, for example, that may move transversely, parallel to axis 18, upon tracks 24 or the like. The transverse movement of the carriage 20 may be controlled by a second motor drive system 26 similar to that of motor drive system 17 but operating a lead screw 28, communicating between the motor drive system 26 and the carriage 20. In particular, the second motor drive system 26 may control the velocity of the carriage 20 and sense the position of the carriage 20 (for example using a rotary encoder mounted on carriage motor system 26 ).

The carriage 20 is positioned to receive the material 16 in a direction generally perpendicular to the axis 18, for example, from a spool (not shown) or from a processing line, for example, a slitting machine, or the like (not shown). The material 16 may pass through feed rollers 32 which may provide a measurement of feed rate of the material 16 through an attached encoder 30 and/or a measurement of the tension on the material 16 through the use of a dancer roller 32' according to well known techniques. Alternatively the drive rollers 32 may be attached to a third motor drive system (not shown) actively driving the material 16 therethrough.

Both of the motor drive systems 17 and 26, and the encoder 30 communicate with an industrial controller 36 or the like, the latter which may be attached to a terminal 38 for the entry of parameters, to be described, by an operator. Industrial controllers are well known in the art and in this case may be an RSLogix controller manufactured by Rockwell Automation Inc. of Milwaukee, Wis., executing the RSLogix 5000 motion language. As is understood in the art, the industrial controller 36 may execute a stored program, for example, written using a motion control language, as will be described below and which implements the present invention.

The industrial controller 36 includes input/output circuitry of a type well known in the art that may provide control signals to the motor drive system 17 and 26 to control the positions of the arbor 12 and lead screw 28 on a real-time basis, and may receive a position signal from the controller 36 providing the angular position of the arbor 12, position information from the motor drive system 26 providing linear position of the carriage 20, and information from the encoder 30 describing the linear rate or tension of the material 16.

Figure 4:
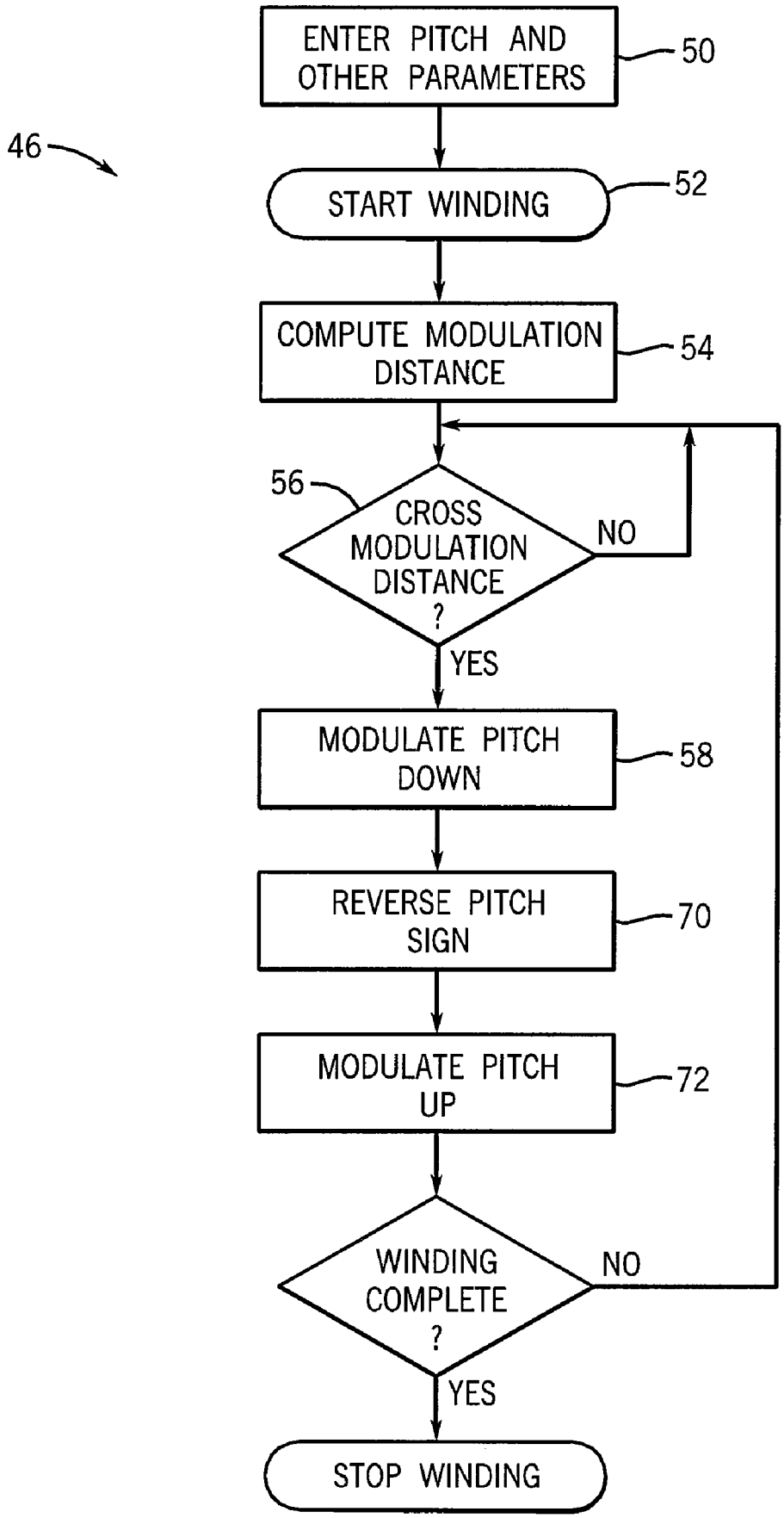
FIG. 4 is a flow chart executed by the controller of FIG. 1 in implementing the present invention.

Referring now to FIG. 4, the industrial controller 36 may execute a program 46 implementing the present invention. At a first process block 50 in the program 46, the user may enter desired operational parameters. As described, these operational parameters may include one or more of the following: the feed rate of wound material and/or its desired tension, the axial limits of transverse motion of the material on the form, the pitch of material to be applied to the form, the maximum amount of material to be applied to the form, the home (start) position of the arbor, and a maximum acceleration of the carriage to provide the desired trade-off between speed of operation and machine wear and vibration.

The feed rate of the wound material and/or its desired tension will generally depend on the particular application and may be freely selected by the user. Similarly, the axial limits of transverse motion of the material, shown in FIG. 1 as endpoints 27*a* and 27*b* , again will be determined by the particular application and the size of the form 14, as will be the maximum amount of material to be applied to the form 14.

Figure 3:
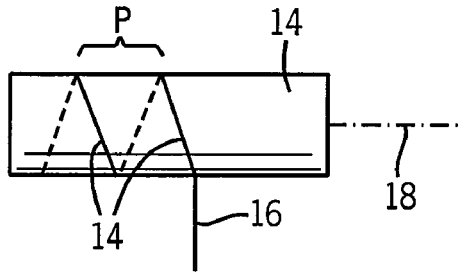
FIG. 3 is a top plan view of the arbor of FIG. 1 simplified to show the definition of pitch.

The pitch of the material applied to the form defines a coordination of the rotational velocity 40 of the arbor 12 with motion of the carriage 20. Referring to FIG. 3, a pitch variable P set by the user defines on an instantaneous basis the desired incremental motion of the carriage 20 for one revolution of the arbor 12 and thus generally indicates an axial separation of adjacent windings 41 of the material 16. In many applications, the pitch must be carefully controlled, for example, to ensure homogeneity of strength in a wound device, particular electrical properties in electrical device, or a sufficient density of packing when material is being spooled by the winding machine 10.

The maximum velocity of the arbor 12 can be determined from the feed rate of the wound material and a known diameter of the form 14 or may represent a user-imposed limit below this amount. The maximum acceleration of the carriage 20 is selected by the user to effect a desired trade-off between machine speed and vibration/torque shock, and is used by the present invention instead of reducing the maximum velocity of the arbor 12 as is normally done. The maximum acceleration of the carriage 20 may be calculated using machine inertia values or determined empirically while observing operation of the winding machine 10.

Figure 2:
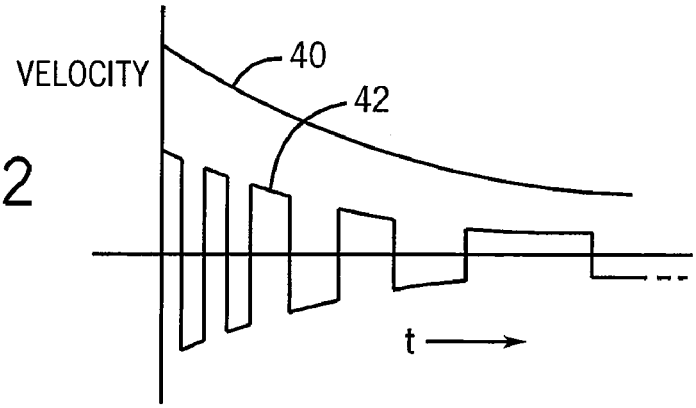
FIG. 2 is a plot of arbor speed and carriage direction, showing the changes in both during a winding operation.

Referring still to FIG. 4, at process block 52 the winding machine 10 may be started. According to normal operation of such winding machines 10, the industrial controller 36 will control the rotational velocity 40 of the arbor 12 according to the feed rate of the material 16 passing from the rollers 32. This coordination may be implemented, for example, by closed loop control of the dancer system that trims the rotational velocity of the arbor 12 to maintain tension on the material 16,. As shown in FIG. 2, in either case, the rotational velocity 40 of the arbor 12 will generally decrease as a function the diameter of the wound form 14 increases.

The industrial controller 36 will also lock the transverse velocity of the carriage 20 to the rotational velocity of the arbor 12 according to the entered pitch variable P. This means that as the rotational velocity of the arbor 12 decreases, the transverse speed of the carriage 20 decreases and the carriage linear velocity 42 decreases and changes direction at a decreasing rate. Generally, during normal operation, the velocity 42 of the carriage 20 as locked to the arbor 12, will be an extremely complex function of time determined by quantities such as linear feed rate, form diameter, number of windings, thickness of the winding material, as well as numerous parameters that cannot be determined except during the operation of the machine, such as the material packing qualities and the like.

Particularly near the beginning of the winding process, when the carriage velocity 42 is high and the carriage direction changes at a rapid rate, high forces of acceleration are exerted on the carriage 20 lead screw 28 and motor drive system 26. Because the speed of the carriage 20 is locked to the rotational velocity 40 of the arbor 12 and because the rotational velocity 40 of the arbor 12 may not be freely changed for reasons of its large rotational inertia and/or the need to avoid abrupt tension changes in the material 16, it is normally difficult to control these high forces of acceleration on the carriage 20 except by reducing the maximum rotational speed of the arbor 12. The present invention, however, reduces the forces of acceleration on the carriage 20, without reducing maximum rotational velocity 40 of the arbor 12 and without a priori knowledge of the extremely complex function of linear velocity 42 of the carriage 20.

Referring again to FIGS. 1 and 4, in the present invention high forces of acceleration of the carriage 20 are significantly reduced by a modulation of the pitch variable P near the endpoint 27 of the carriage 20. As indicated by process block 54, upon operation of the winding machine 10, a "modulation distance" is determined automatically by evaluating the maximum speed of the carriage 20 and the maximum desired acceleration of the carriage 20 entered by the user as described above. The calculation of modulation distance, for example, may determine the necessary time for deceleration from the maximum speed of the carriage 20 according to the maximum acceleration, and using this calculated time value determine a distance of movement of the carriage 20 or preferably the arbor 12 value using standard formulas relating acceleration to distance. As noted, modulation distance may be defined with respect to the position of the carriage 20 or with respect to the position of the arbor 12 based on the general correspondence of these two values as defined by the pitch variable P.

Figure 5:
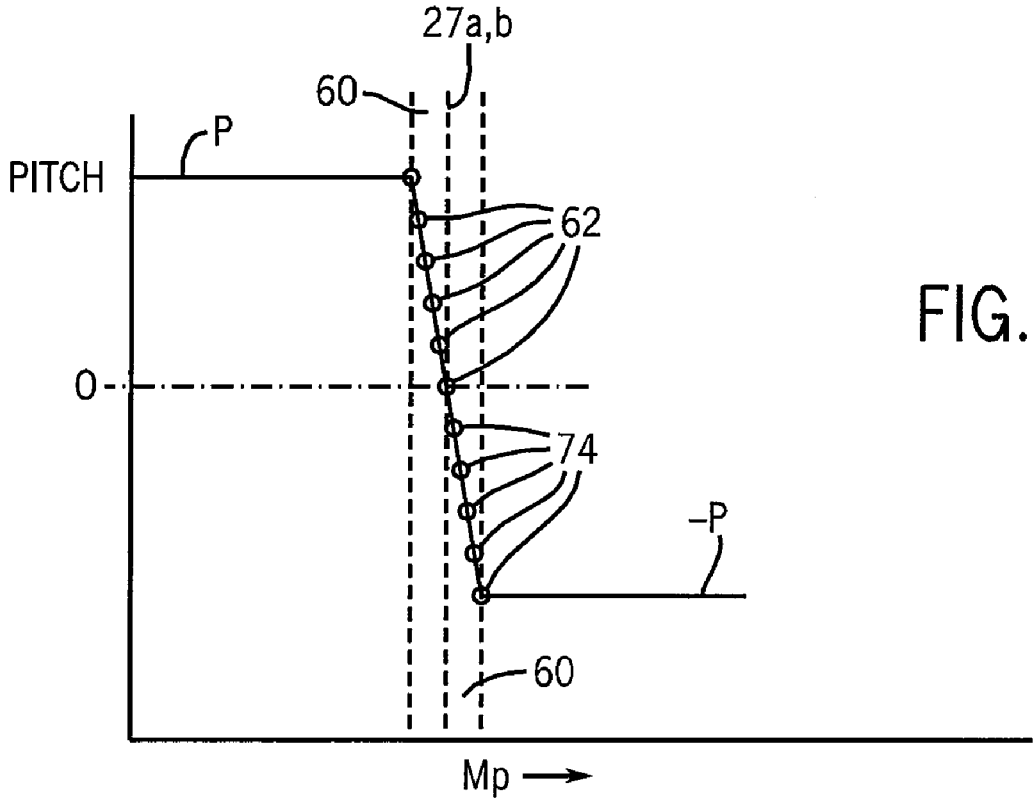
FIG. 5 is a plot of pitch value as a function of arbor rotational position showing the pitch modulation of the present invention.

Referring momentarily to FIG. 5, during most of the operation of the winding machine 10, the pitch variable P will have an essentially constant magnitude, changing in sign, when the carriage reaches the endpoints 27*a* and 27*b* , from P to −P causing the carriage to reverse but maintain a constant pitch magnitude. In the present invention the pitch is modulated as the carriage approaches to within the modulation distance 60 of an endpoint 27.

As indicated by decision block 56, the position of the arbor 12 (or carriage 20) is monitored to see if the modulation distance 60 from the closest endpoint 27*a* or 27*b* has been crossed. If not, the winding continues with the pitch variable P held constant; if so, the program proceeds to process block 58.

At process block 58 the pitch variable P entered by the user is modulated downwards in a series of steps being generally a function of arbor position mp or carriage position. As shown in FIG. 5, in a preferred embodiment a set of discrete pitch modulations 62 will be created providing equal steps in pitch between the pitch variable P entered by the user and a zero value of pitch (no carriage movement for finite arbor movement). This pitch modulation preferably is a function of the rotation of the arbor 12 and thus provides equal increments of arbor rotation between modulations 62. Because of the manner of selecting the modulation distance 60, an integral number of pitch modulations 62 evenly dividing the pitch variable P will cause a zero pitch to be reached exactly as the carriage arrives at endpoint 27*a* or *b*.

Figure 6:
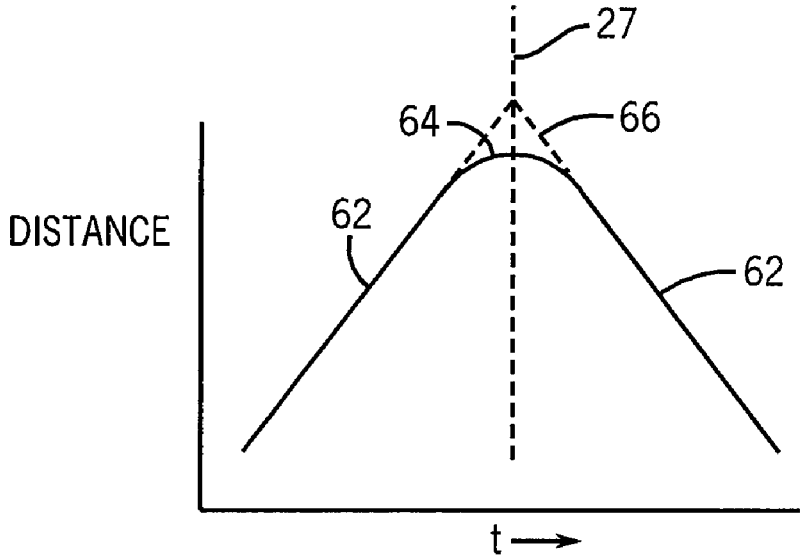
FIG. 6 is a plot of carriage position as a function of time showing a rounding of the carriage's position trajectory such as substantially reduces accelerative forces on the carriage.

Referring to FIG. 6, in the time domain, the modulations 62 of the carriage 20 will move from a generally constant velocity as indicated by the straight upward slope of the position line to a deceleration indicated by a curved region 64, the latter caused by the pitch modulation. This curved region 64 substantially decreases the force of deceleration on the carriage 20 (and thus on the elements attached to the carriage, lead screw 28 and the motor drive system 26 and its drive electronics) in contrast to the abrupt velocity change that would be implemented without pitch modulation as shown by dotted lines 66.

Once the pitch modulations arrived at zero pitch (and the carriage 20 has arrived at endpoint 27*a* or *b*), as indicated by process block 70 of FIG. 4, the sign of the pitch variable P is reversed to cause the carriage 20 to return along the direction from which it came.

As indicated by process block 72, the pitch is then modulated upward by pitch modulations 74 equal in number and size to pitch modulations 62. Again the pitch modulations 74 may be triggered as a function of arbor position. Because the number of pitch modulations 74 is equal to the number of pitch modulations 62, at the conclusion of process block 72, the arbor 12 has passed beyond the modulation distance 60 and the pitch has been returned to a magnitude of pitch variable −P as originally entered by the user.

Referring to FIG. 6, it will be seen that for the most part, the movement of the carriage 20 with pitch modulation exactly tracks the trajectory of the carriage 20 without pitch modulation deviating only within the modulation distance 60 of endpoints 27*a* or *b* as shown by dotted line 66. Thus, the winding over most of the form 14 will be completely unaffected and only slight variations in the pitch are required at the ends of the form 14 where they may be readily accommodated. In practice, the modulation distance may be as little as 8/10 of a revolution of the form for practical applications.

By using modulation of pitch, the speed of the arbor 12 need not be affected and a precise characterization of the complex carriage linear velocity 42 function is not required.

It will be understood generally that the processing described in the present invention may be distributed arbitrarily among hardware components and that the controller functionality can in fact be implemented by the motor drive systems and that drive functionality can also be implemented in part by a separate industrial controller. Accordingly, the present invention should not be considered limited to particular hardware configurations.

It is intended that the present invention not be limited to the embodiments and illustrations contained herein, but modified forms of those embodiments including portions of the embodiments and combinations of elements of different embodiments as come within the scope of the following claims.

I claim:

1. A computer-controlled winding machine comprising:

an arbor rotatable about an axis to support a form for winding a material over the form;

an arbor drive system rotating the arbor and providing an arbor rotation position signal;

a transverse carriage movable along the axis with respect to the arbor, the carriage moving to change a point of winding of the material on the form over a range of transverse locations along the axis of the arbor;

a transverse carriage drive system moving the transverse carriage according to a transverse carriage signal and providing at least one position signal indicating transverse locations at either axial end of the form; and a controller communicating with the arbor drive system and the transverse carriage drive system and executing a stored program to:

(a) at positions of the point of winding between axial ends of the form, electronically lock movement of the transverse carriage to the arbor rotation position signal according to a user determined pitch variable and defining a winding pitch of the material to provide a substantially constant magnitude of pitch of winding;

(b) at positions of the point of winding at the axial ends of the form, reverse the sign of the pitch variable to reverse direction of the carriage; and (c) at predetermined distances to the axial ends of the form, modulate the pitch variable changing the magnitude of the pitch of winding to reduce accelerative forces, wherein the modulation decreases a magnitude of the pitch variable as the carriage is moving toward a closest given axial end of the form and increases the magnitude of the pitch variable as the carriage is moving away from the closest given axial end of the form, the increases and decreases adding to zero; while continuing to electronically lock movement of the transverse carriage to the arbor rotation position signal according to the modified pitch variable.

2. The computer-controlled winding machine of claim 1 wherein the modulation in the pitch variable is a linear function of arbor position.

3. The computer-controlled winding machine of claim 1 wherein the controller varies arbor rotational speed during winding.

4. The computer-controlled winding machine of claim 3 wherein the controller holds arbor rotational speed substantially constant during motion of the carriage through positions within the predetermined distances from the ends of the form.

5. The computer-controlled winding machine of claim 3 wherein the controller automatically computes the predetermined distances based on a maximum speed of the arbor during winding and a maximum acceleration sought in the carriage.

6. The computer-controlled winding machine of claim 1 wherein the modulation of the pitch variable is locked to the arbor rotation by a modulation variable.

7. An electronic computer executing a stored program to control a winding machine having an arbor rotatable about an axis to support a form for winding a material over the form, the arbor rotated by an arbor drive system, the arbor drive system providing an arbor rotation position signal and having a carriage movable along the axis, the carriage moving a point of winding of the material on the form over a range of transverse locations along the axis of the arbor, where the carriage is moved by a transverse carriage drive system according to a transverse carriage signal, the transverse carriage drive system providing at least one position signal indicating transverse locations at either axial end of the form, the material supplied to the form by means of a feed mechanism, the electronic computer executing the stored program to:

(a) accept from an operator a value of a pitch variable describing a desired winding pitch of material about the form;

(b) rotate the arbor;

(c) at positions of the point of winding between the axial ends of the form, electronically lock movement of the transverse carriage, with respect to the arbor, to the arbor rotation position signal according to the pitch variable entered by a user to provide a substantially constant magnitude of the pitch of winding;

(d) at positions of the point of winding at the axial ends of the form, reverse the sign of the pitch variable to reverse direction of the carriage; and (e) at predetermined distances to the axial ends of the form, modulate the pitch variable to change the magnitude of the pitch of winding to reduce accelerative forces, wherein the modulation decrease a magnitude of the pitch variable as the carriage is moving toward a closest end of the form and increases the magnitude of the pitch variable as the carriage is moving away from the closest end of the form, the increases and decreases adding to zero, while continuing to electronically lock movement of the transverse carriage to the arbor rotation position signal according to the modified pitch variable.

8. The electronic computer of claim 7 wherein the modulation in pitch variable is a linear function of arbor position.

9. The electronic computer of claim 7 wherein the program varies arbor rotational speed during winding.

10. The electronic computer of claim 9 wherein the controller holds arbor rotational speed substantially constant during motion of the carriage through positions within the predetermined distances from the ends of the form.

11. The electronic computer of claim 9 wherein the controller automatically computes the predetermined distances based on a maximum speed of the arbor during winding and a maximum acceleration desired for the carriage.

12. The electronic computer of claim 7 wherein the modulation of the pitch variable is locked to arbor rotation by a modulation variable.

* * * * *